US007530902B2

(12) United States Patent
Nakamura

(10) Patent No.: US 7,530,902 B2
(45) Date of Patent: May 12, 2009

(54) IRON-TYPE GOLF CLUB HEAD

(75) Inventor: Takashi Nakamura, Kobe (JP)

(73) Assignee: SRI Sports Limited, Kobe-Shi, Hyogo (JP)

( * ) Notice: Subject to any disclaimer, the term of this patent is extended or adjusted under 35 U.S.C. 154(b) by 77 days.

(21) Appl. No.: 11/785,374

(22) Filed: Apr. 17, 2007

(65) Prior Publication Data

US 2007/0287556 A1 Dec. 13, 2007

(30) Foreign Application Priority Data

Jun. 12, 2006 (JP) ..... 2006-162588

(51) Int. Cl.
*A63B 53/04* (2006.01)

(52) U.S. Cl. ..... 473/334; 473/349; 473/350; 473/335

(58) Field of Classification Search ..... 473/324–350
See application file for complete search history.

(56) References Cited

U.S. PATENT DOCUMENTS 5,076,585 A * 12/1991 Bouquet ..... 473/343
5,492,327 A * 2/1996 Biafore, Jr. ..... 473/332
5,536,011 A * 7/1996 Gutowski ..... 473/350
5,540,436 A * 7/1996 Boone ..... 473/350
5,584,770 A * 12/1996 Jensen ..... 473/350
5,593,356 A * 1/1997 Takeda ..... 473/335
5,599,243 A * 2/1997 Kobayashi ..... 473/335
5,613,917 A * 3/1997 Kobayashi et al. ..... 473/335
5,616,088 A * 4/1997 Aizawa et al. ..... 473/341
5,669,826 A * 9/1997 Chang et al. ..... 473/332
5,816,936 A * 10/1998 Aizawa et al. ..... 473/342
5,833,551 A * 11/1998 Vincent et al. ..... 473/350
6,083,118 A * 7/2000 Martins et al. ..... 473/334
6,210,290 B1 * 4/2001 Erickson et al. ..... 473/345
6,440,010 B1 * 8/2002 Deshmukh ..... 473/335
6,554,719 B2 * 4/2003 Peters et al. ..... 473/291
7,022,027 B2 * 4/2006 Chen ..... 473/291

FOREIGN PATENT DOCUMENTS

JP 9-262327 A 10/1997
JP U3114961 11/2005

* cited by examiner

*Primary Examiner*—Sebastiano Passaniti
(74) *Attorney, Agent, or Firm*—Birch, Stewart, Kolasch & Birch, LLP

(57) ABSTRACT

An iron-type golf club head 1 having an improved moment of inertia without impairing the productivity and comprising a face portion 1A which includes a body 10 having a club face 2 on its front side and an annular weight member 11 fixed to a peripheral edge portion on the back face side of the body 10 and having a larger specific gravity than the body 10, in which at least a part of the weight member 11 is exposed onto the club head's outer circumference surface including top, sole and toe, and the body 10 is provided on its back face 6 side with an annular recess portion 14 into which the weight member 11 is fixed and which has an outside-facing surface 13*a* fitted to an internal circumference surface 11*i* of the annular weight member 11.

11 Claims, 11 Drawing Sheets

IRON-TYPE GOLF CLUB HEAD

BACKGROUND OF THE INVENTION

The present invention relates to an iron-type golf club head having weight effectively allocated about the periphery of a face plate and having a large moment of inertia.

An iron-type golf club head comprising a face plate and a body in which a weight member having a larger specific gravity than the body is fixed to the rear side of the body in order to adjust the club head's center of gravity and the moment of inertia to desired values, are proposed, for instance, in Japanese Registered Utility Model No. 3114961 (JP-U3114961) and Japanese published Patent Application No. 9-262327 (JP 9-262327 A).

JP-U3114961 discloses an iron-type golf club head A1 as shown in FIG. 12(*a*), comprising a body "a" having a flat back face "b" and an annular weight member "c" attached to the back face "b". FIG. 12(*b*) shows a cross sectional view of the golf club head A1.

JP 9-262327 A discloses an iron-type golf club head A2 as shown in FIGS. 13(*a*) and 13(*b*), comprising a body "a" having an annular groove "d" formed in a back face "b" at a location slightly apart from the periphery "f" of the club head body toward the face center side, and an annular weight member "c" having the same shape as the groove "d" and fixed into the groove "d".

However, the club head A1 of the type shown in FIGS. 12(*a*) and 12(*b*) has problems that defective goods having a low accuracy of joining the body "a" and the weight member "c" together are apt to be produced thus lowering the production yield, since exact positioning between the both members "a" and "c" is not conducted and mispositioning is apt to occur when joining them together, for instance, by welding.

The club head A2 of the type shown in FIGS. 13(*a*) and 13(*b*) has problems that since the outer peripheral surface of the weight member "c" is covered with a peripheral portion "e" of the body "a" which has a relatively low specific gravity, a larger amount of weight cannot be allocated on the periphery "f" side and, therefore, an effect of increasing the moment of inertia is not sufficiently obtained.

Thus, it is an object of the present invention to provide an iron-type golf club head having an increased moment of inertia.

A further object of the present invention is to provide an iron-type golf club head having a weight distribution such that a larger amount of weight is allocated about its periphery without impairing the productivity.

A still further object of the present invention is to provide an iron-type golf club head having a high accuracy of joining a weight member to a club head body.

These and other objects of the present invention will become apparent from the description hereinafter.

SUMMARY OF THE INVENTION

In the present invention, in order to achieve the above objects, an annular weight member is fixed to a body of an iron-type golf club head so that at least a part of the annular weight member is exposed to form at least a part of the periphery of the club head, while a concave portion having a surface facing to the outside, to which an inside peripheral surface is fitted, is provided in the body.

In accordance with the present invention, there is provided an iron-type golf club head comprising a face portion including a front face for hitting a golf ball, a top extending from the upper edge of the front, face and forming an upper surface of the club head, a sole extending from the lower edge of the front face and forming a bottom surface of the club head, a toe connecting the top and the sole on a toe side of the club head, and a back face, in which the face portion comprises a body having the front face on its front side, and an annular weight member which annularly extends along a peripheral edge portion on the back face side of the body and is fixed to the back face of the body and which has a larger specific gravity than that of the body, at least a part of the weight member is exposed to the outer circumference surface of the face portion, and the body is provided on its back face side with an annular recess portion which has a surface facing the outside and capable of fitting to an internal circumference surface of the weight member and into which the weight member is fitted.

In a preferable embodiment of the present invention, the body of the face portion of the golf club head includes a face plate which provides a front part of the outer circumference surface of the face portion, and an annular protruding portion which protrudes on the back face side from the rear surface of the face plate at a location on the face center side with respect to the outer circumference surface of the face portion. The annular recess portion for fitting the weight member therein is formed by the rear surface of the face plate, an outer circumference wall of the annular protruding portion which provides the above-mentioned outside-facing surface of the recess portion, and a corner portion formed by intersection of them, so the club head periphery side of the annular recess portion is opened. The annular weight member is fitted into the annular recess portion having an L-shaped cross section so that the outer circumference surface of the weight member forms a rear part of the outer circumference surface of the face portion. The face portion is provided on its back face with a cavity defined by the annular protruding portion such as an annular rib. The weight member has a sole weight portion extending along the sole in the toe-and-heel direction, and the height of the sole weight portion gradually decreases from its center portion toward both the toe and heel sides.

In the iron-type golf club head of the present invention comprising a face portion and a hosel portion, since a weight member is fixed to a body of the face portion so that at least a part of the weight member is exposed to at least a part of the outer circumference surface of the face portion, a larger amount of weight is allocated to the club's periphery and, therefore, the club head can possess a large moment of inertia. Further, since the body of the face portion is provided with an annular recess having an outside-facing surface to be mated with the inner wall of the annular weight member, positioning between the body and the weight member can be easily performed when joining them and dislocation is prevented to significantly improve the joining accuracy.

DETAILED DESCRIPTION OF THE INVENTION

Figure 1:
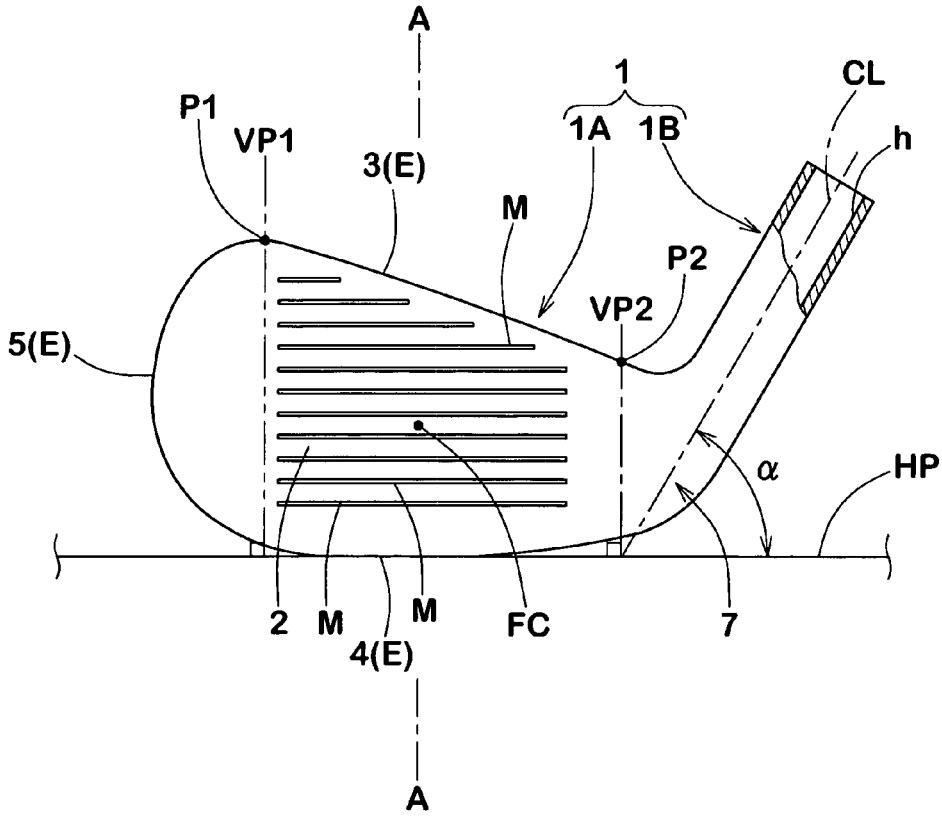
FIG. 1 is a front view of an iron-type golf club head in the standard state according to an embodiment of the present invention.

An embodiment of the present invention will now be explained with reference to the accompanying drawings.

FIGS. 1 to 7 show an iron-type golf club head 1 according to an embodiment of the present invention. In these drawings, the club head 1 is placed in the standard state. The term "standard state" as used herein denotes the state that the club head 1 is placed on a horizontal plane HP with keeping prescribed lie angle $\alpha$ and loft angle (real loft angle) $\beta$. The sizes and directions of respective portions of the club head 1 denote those measured in the standard state unless otherwise noted. For example, with respect to the club head 1, the up-and-down direction and the terms "high" and "low" denotes those of the club head 1 in the standard state. Further, the front-and-rear direction or the terms "front" and "rear (or back)" denote that face 2 side is the front and back face side is the rear. In the case that a shaft is not attached, the center line CL of a shaft inserting hole "h" of a hosel 1B is used, instead of the axis of the club shaft, as a basis to determine the lie angle $\alpha$.

The club head 1 comprises a face portion 1A, and a hosel portion 1B in an approximately cylindrical from which is provided through a heel 7 of the face portion 1A and to which a shaft (not shown) is attached.

The face portion 1A includes a club face 2 for hitting a golf ball on its front side, a top 3 which intersects with the face 2 at its upper edge and forms the upper surface of the head 1, a sole 4 which intersects with the face 2 at its lower edge and forms the bottom surface of the head 1, a toe 5 connecting the top 3 and the sole 4 on the toe side, and a back face 6 which is a face on the side opposite to the face 2. A surface including all the top 3, the sole 4 and the toe 5 may be hereinafter referred to as "club head's outer circumference surface E" or "outer circumference surface E of the face portion 1A". The face portion 1A in this embodiment has a so-called cavity back structure that a cavity C dented toward the face 2 side is formed in the back face 6.

The face 2 may be provided with an impact area marking M in order to increase the friction with a ball. The impact area marking M includes, for instance, grooves and/or punch mark such as small dot-like dents, as described in the Rule of Golf established by Japan Golf Association, Section II of Additional Rule, Paragraph 5 "Club Face". A plurality of grooves which substantially horizontally extend in the toe-and-heel direction are preferred as an impact area marking M on the face 2. The face 2 is formed substantially by a single plane, excepting the impact area marking M and, therefore, the respective edges such as top edge, toe edge and sole edge are defined by the edges of this plane.

As shown in FIG. 1, the face 2 includes a toe side point P1 located at the highest position of the top edge of the face 2, and a heel side point P2 located at the lowest position of the top edge of the face 2. These points P1 and P2 are present on the above-mentioned single plane. A plane passing through the toe side point P1 and vertical to the face 2 is referred to as a toe side vertical plane VP1, and a plane passing through the heel side point P2 and vertical to the face 2 is referred to as a heel side vertical plane VP2.

The top 3 is defined as an upper surface portion of the head 1 which extends between the toe side vertical plane VP1 and the heel side vertical plane VP2. Preferably, the top 3 extends almost linearly while inclining downwardly from the toe toward the heel according to conventional iron-type golf club heads. The sole 4 is defined as an bottom surface portion of the head 1 which extends between the toe side vertical plane VP1 and the heel side vertical plane VP2, and the greater part of the sole extends almost horizontally in the toe-and-heel direction. The toe 5 is defined as an edge surface portion located on the toe side with respect to the toe side vertical plane VP1. The toe 5 shown in this embodiment is smoothly curved in an arc-like form convex toward the outside.

Figure 5:
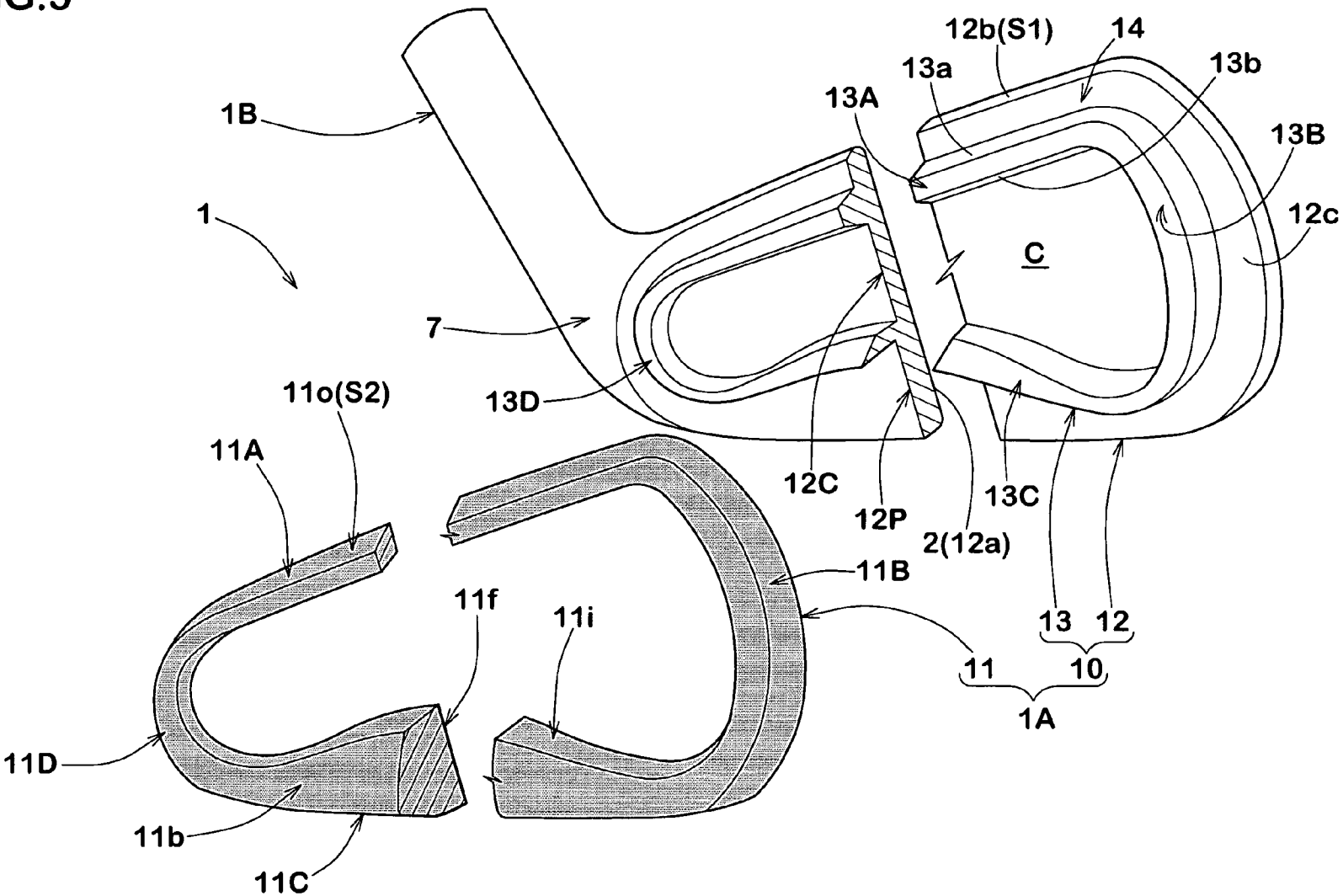
FIG. 5 is an exploded view (partly broken) of the club head shown in FIG. 4.
Figure 6:
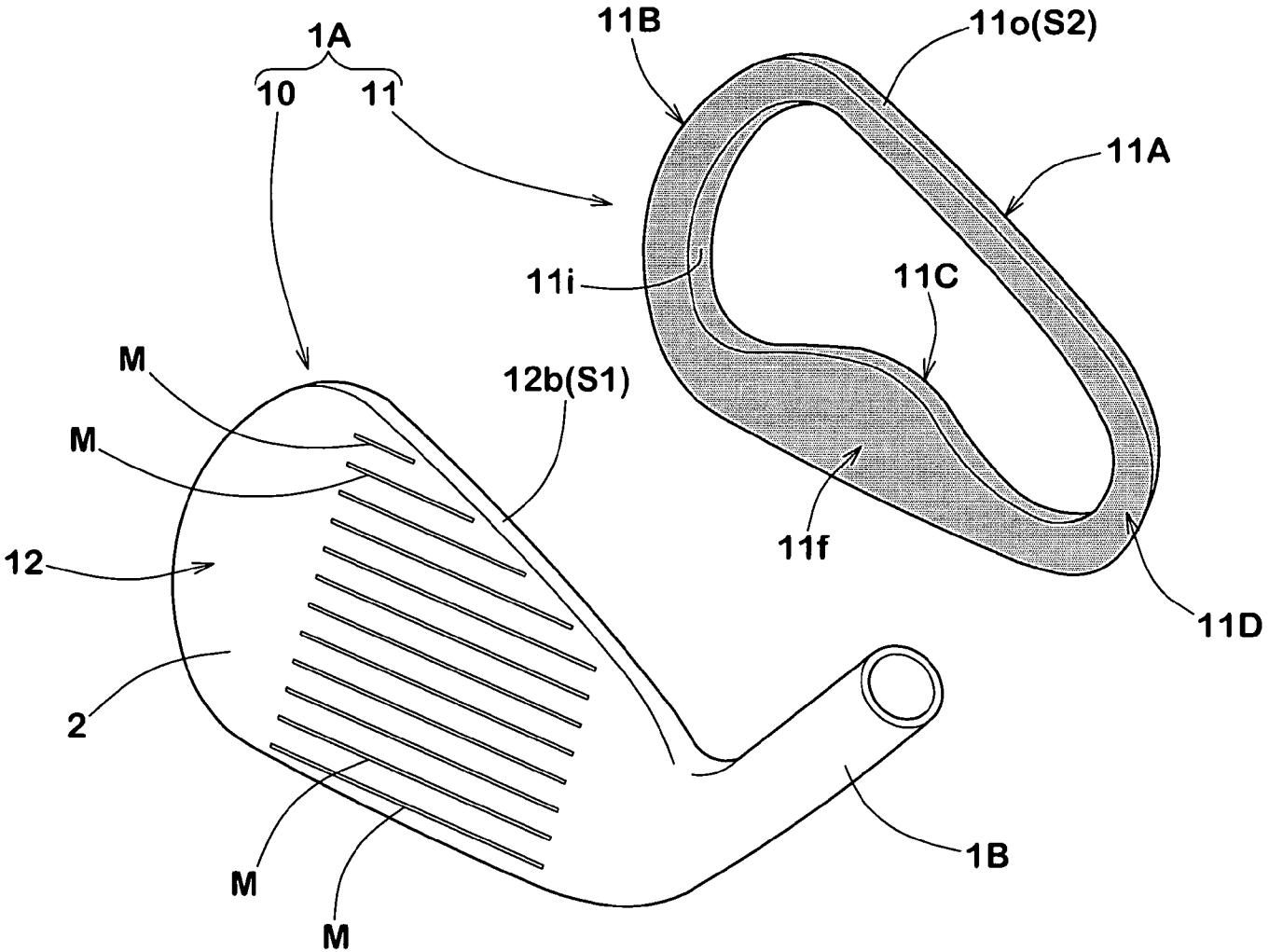
FIG. 6 is an exploded view of the club head shown in FIG. 1.

The face portion 1A comprises, as shown in FIG. 5, a body 10 having the club face 2 on its front side, and an annular weight member 11 which extends annularly about a periphery of the back face 6 of the body 10 and has a larger specific gravity than that of the body 10.

In this embodiment as shown in FIGS. 1 to 7, the body 10 includes a face plate 12, on the front surface 12*a* of which is formed the whole area of the face 2, and the side surface 12*b* of which forms a front part S1 of the club head's outer circumference surface E; and a protruding portion 13 which protrudes backward of the club head and which is located on the rear surface 12*c* of the face plate 12. A hosel portion 1B is integrally provided on the heel side of the face plate 12.

The head body 10 can be produced from a metal material by various methods, preferably by casting or forging from the viewpoint of productivity. In order to relatively increase the weight of a peripheral portion of the face portion 1A by attaching a weight member 11 having a large weight to the head body 10, a metal material having a specific gravity of at most 8.0, especially at most 7.9, is preferred as a material for forming the body 10. As such a metal material are preferred, for instance, a low carbon steel having a carbon content of less than 0.3% by weight (so-called soft iron, specific gravity about 7.9) and a stainless steel (specific gravity about 7.9). Other metal materials can of course be used, e.g., marageing steel (specific gravity about 7.8), nickel-chrome steel (specific gravity about 7.8) and chrome steel (specific gravity about 7.8).

From the viewpoint of controlling excess increase of the weight of club head 1 while securing a sufficient moment of inertia, the weight of body 10 is preferably at least 130 g, more preferably at least 140 g, further preferably at least 150 g, and it is also preferably at most 240 g, more preferably at most 230 g, further preferably at most 220 g.

In the specification, the "moment of inertia" of golf club head 1 denotes a moment of inertia about the vertical axis through the center of gravity of the golf club head, unless otherwise noted.

The face plate 12 includes a central portion 12C surrounded by the protruding portion 13, and a peripheral edge portion 12P located outside of the protruding portion 13.

Figure 3:
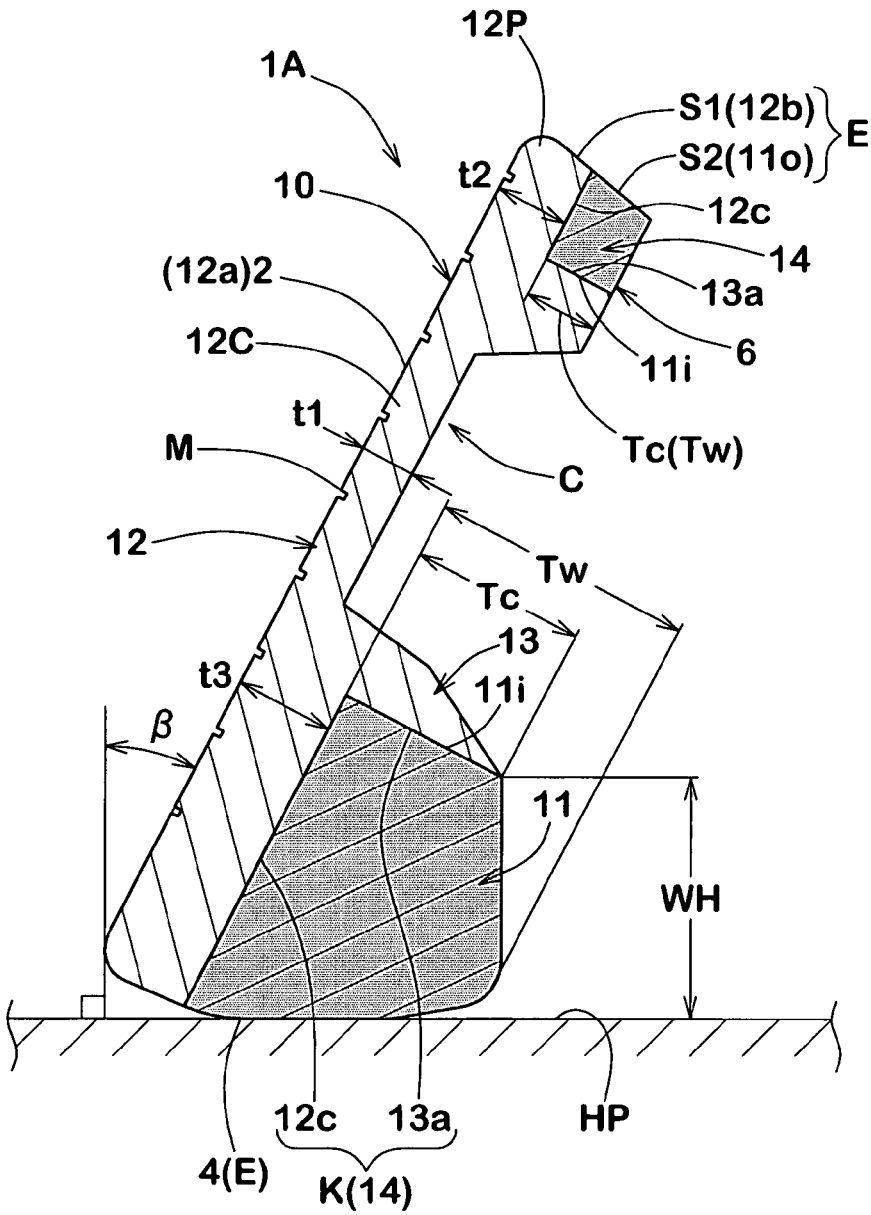
FIG. 3 is an enlarged cross sectional view along the line A-A of FIG. 1.
Figure 4:
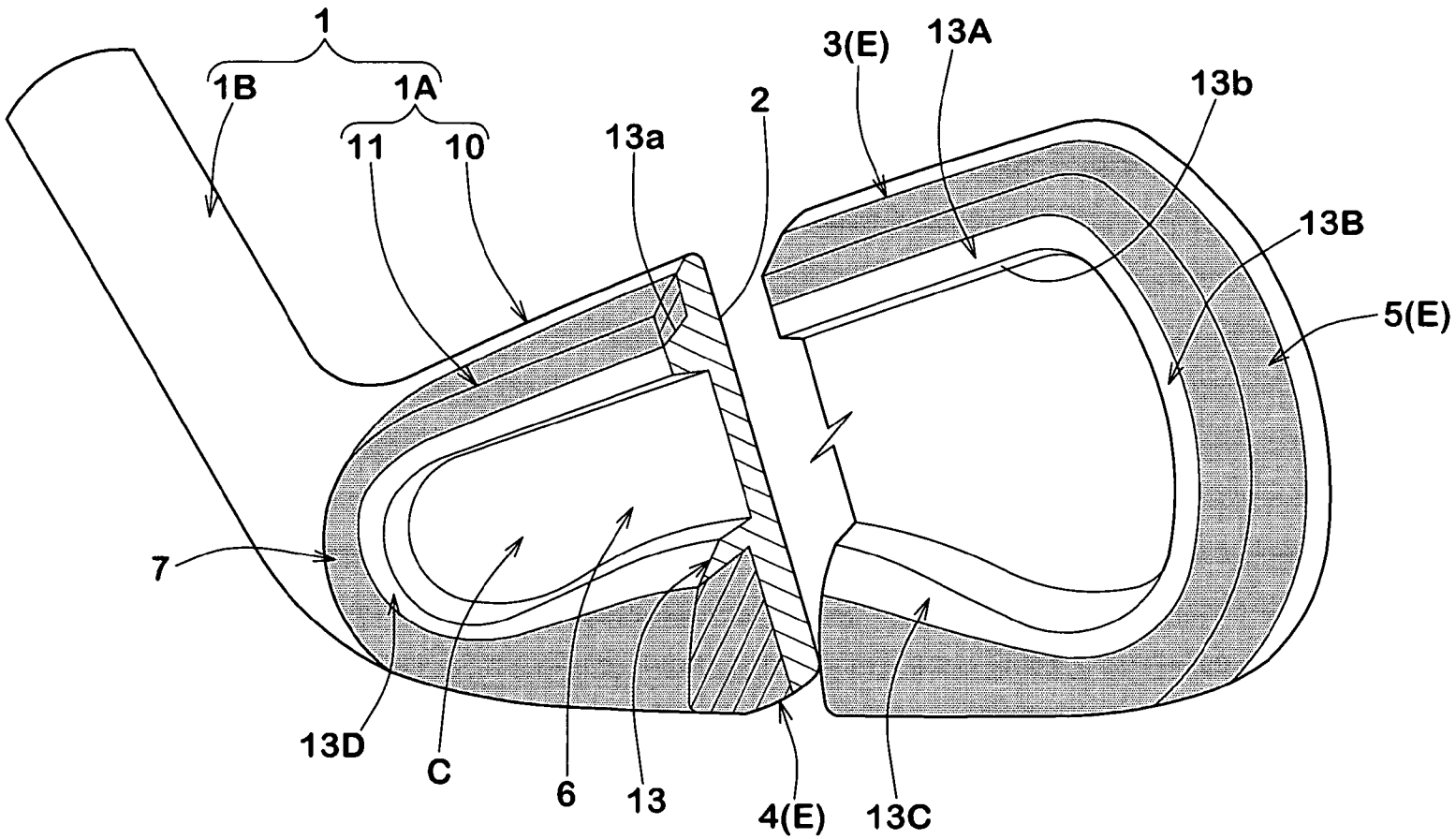
FIG. 4 is a perspective view of the club head of FIG. 1 viewed from the back face side.

It is preferable that, as shown in FIG. 3, the thickness t1 of the central portion 12C is smaller than the thicknesses t2 and t3 of the peripheral edge portion 12P, whereby the face plate 12 itself also contributes to increase in moment of inertia, since the weight of a peripheral portion of the face plate is increased while the weight of the central portion is decreased. Further, this configuration wherein the thickness t1 of the central portion 12C is made small relatively serves to enhance the repellency of the golf club head 1, since the central portion 12C may be effectively bent when striking a golf ball. If the thickness t1 of the central portion 12C is too small, the face plate 12 is short of strength, thus lowering the durability of the club head 1. If the thickness t1 of the central portion 12C is too large, it is disadvantageous to moment of inertia and repellency. From such viewpoints, the thickness t1 is preferably at least 1.5 mm, more preferably at least 1.8 mm, further preferably at least 2.0 mm, and is preferably at most 3.8 mm, more preferably at most 3.6 mm, further preferably at most 3.0 mm.

Further, as to the peripheral edge portion 12P of the face plate 12, it is preferable that the thickness t2 of an upper part located on the top 3 side with respect to the protruding portion 13 is smaller than the thickness t3 of a lower part located on the sole side with respect to the protruding portion 13, whereby a club head 1 having a low club head's center of gravity and accordingly advantageous to flight distance of ball can be provided. From such a point of view, the t3/t2 ratio of the thickness t3 of the lower part to the thickness t2 of the upper part of the peripheral portion 12P is preferably at least 1.1, more preferably at least 1.2, and is preferably at most 2.0, more preferably at most 1.8.

The protruding portion 13 of the body 10 is formed in the form of a rib annularly extending to surround the cavity C. The protruding portion 13 has an inside-facing surface 13*b* (inner wall) which faces the face center side, and an outside-facing surface 13*a* (outer wall) which faces an opposite side to the inside-facing surface 13*b*, namely the outside of the club head. Thus, as a whole, the protruding portion 13 is in the form of a long sideways annulus which extends along approximately the contour of the face plate 12. The protruding portion 13 is composed of a top side rib 13A extending along the top 3, a toe side rib 13B extending along the toe 5, a sole side rib 13C extending along the sole 4, and a heel side rib 13D which extends about the heel 7 and connects the top side rib 13A and the sole side rib 13C.

The outside-facing surface 13*a* is provided by the outer wall of a rib-like protruding portion 13 protruding on the back face 6 side of the club head, and it annularly extends on the rear surface 12*c* of the face plate 12 at a location on the face center side with respect to the front part S1 of the club head's outer circumference surface E. Herein, the term "face center" or "center of face" means a "centroid of area" FC of the face 2 as shown in FIG. 1, and accordingly the term "face center side" means a centroid of area FC side with respect to the outer circumference surface E of the face portion 1A. The inclination of the outside-facing surface 13*a* is suitably determined so that an annular weight member 11 can be fitted from the back face 6 side to the protruding portion 13 of the body 10 with an internal circumference surface 11*i* of the weight member 11 coming in contact with the outside-facing surface 13*a*. In this embodiment, the outside-facing surface 13*a* is formed by a face approximately perpendicular to the club face 2, but may of course be a face inclined at other angles such as a side of a tapered rib-like protrusion which tapers from the back face side.

The body 10 has a recess portion 14 for fitting the weight member 11 therein, as shown in FIG. 3, which is formed by the outside-facing surface 13*a* and the rear surface 12*c* of face plate 12 which intersect to form a reentrant corner portion K The recess portion 14 extends from the outside-facing surface 13*a* to the front part S1 of the club head's outer circumference surface E. That is to say, the recess portion 14 of the head body 10 is opened to the outside of the club head on its outer circumference surface E side.

Figure 13A:
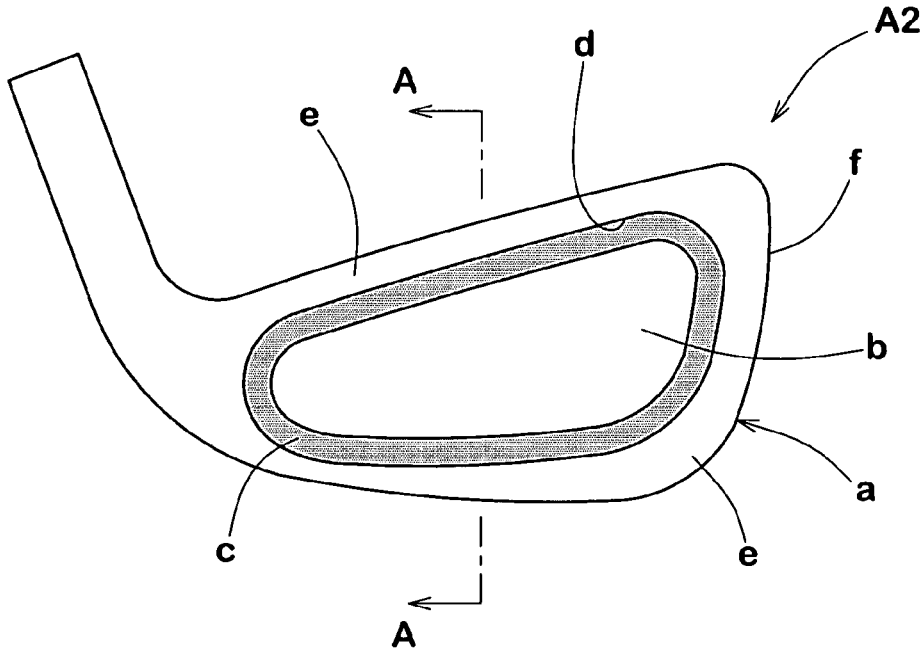
FIG.13(a) PRIOR ART
FIG. 13(*a*) is a back view of a conventional iron-type golf club head and FIG. 13(*b*) is a cross sectional view along the line A-A of FIG. 13(*a*).
Figure 13B:
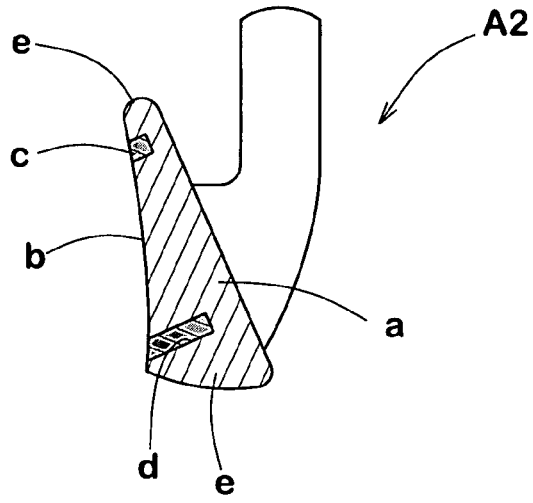
FIG.13(b) PRIOR ART

In the embodiment shown in FIGS. 1 to 7, the recess portion 14 is opened on its outer circumference surface E side over substantially the whole region of the outer circumference surface E, and it is different from an annular groove-like recess portion of a conventional golf club head as shown in FIG. 13 in which both the club head's outer circumference surface side and the face center side of the recess portion are closed by groove walls. The recess portion 14 having such a configuration enables a weight member to be disposed to expose at the club head's outer circumference surface E. Further, since such a recess portion 14 makes it possible to decrease an area of substantially contacting the weight member 11 as compared with the conventional club head, troubles such as shake resulting from processing accuracy are decreased when fitting the weight member 11 to the body 10, thus improving the productivity.

Figure 7:
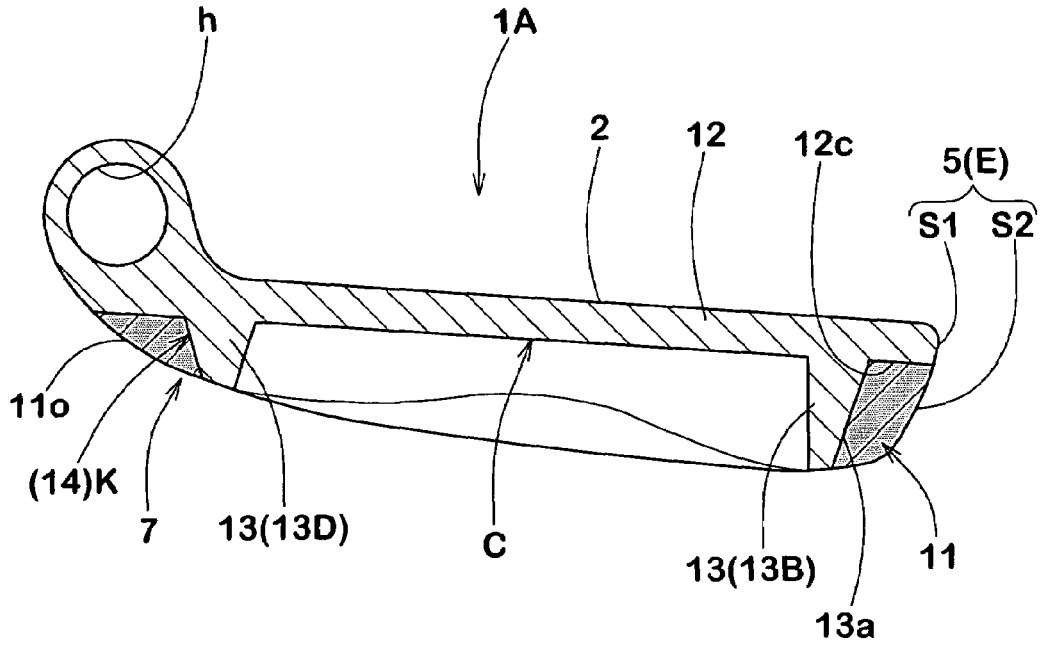
FIG. 7 is an enlarged cross sectional view along the line B-B of FIG. 2.
Figure 8:
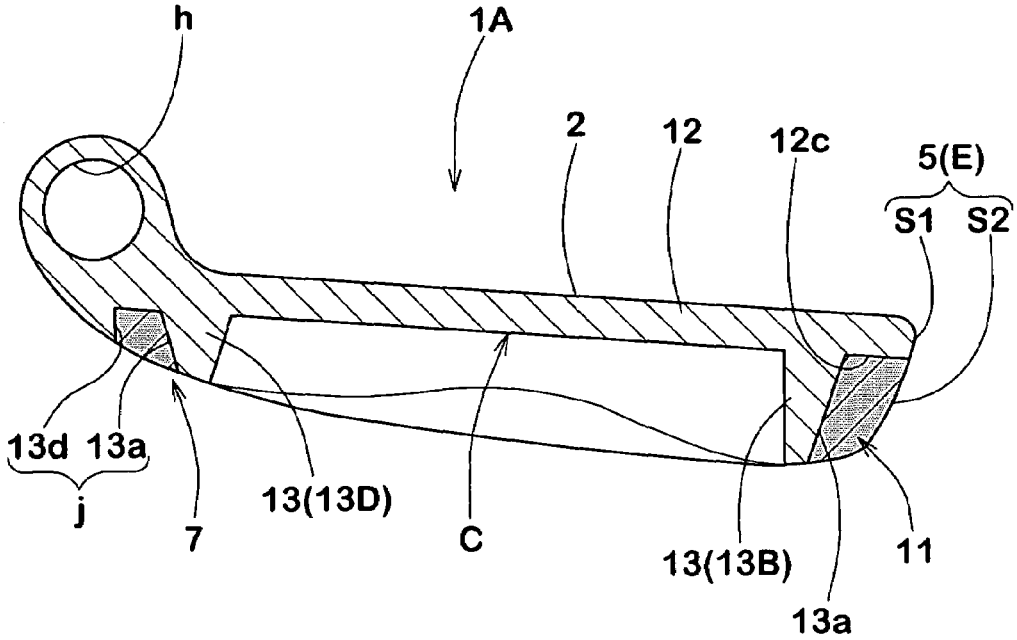
FIG. 8 is a cross sectional view taken along the line B-B as shown in FIG. 2 illustrating another embodiment of the present invention.

A part of the recess 14 is located in the heel 7 of the club head 1. As shown in FIG. 7 which is a cross sectional view along the line B-B of FIG. 2, a portion, which extends on the heel, of the recess 14 is formed by a reentrant corner portion K so that the weight member 11 is opened to the outside on the back face side of the heel 7. However, the recess 14, including such a heel side portion, may be partly in the form of a recess having a wall 13*d* facing the outside-facing surface 13*a*, as shown in FIG. 8, in other words, the recess 14 may partly include a groove-like portion "j" having both groove walls. In that case, in order to enhance the efficiency of the step of fitting the weight member 11 into the recess 14, the proportion of the length of the groove-like portion "j" based on the full length of the recess 14 is preferably at most 50%, more preferably at most 30%, further preferably at most 10%.

The weight member 11 is formed into an oblong, continuous annular body. It can be produced by various methods such as casting, forging, cutting, sintering and the like. The material for forming the weight member 11 is not particularly limited so long as it has a specific gravity larger than that of the body 10. In order to effectively increase the moment of inertia of the club head 1, preferred is a metallic material having a specific gravity of at least 8.5, especially at least 9.0, more especially at least 9.5. If the specific gravity of the weight member 11 is too large, the material cost increases and further there is a fear of increase in the head weight. So, it is preferable that the specific gravity of the weight member 11 is at most 13.0, especially at most 12.5, more especially at most 12.0.

As such a metallic material of the weight member 11 is preferred a tungsten alloy, particularly a metallic material weldable with the body 10. The metallic material of the weight member 11 is selected according to the kind of the body 10. For example, in case that the body 11 is made of a stainless steel or a soft iron, a tungsten alloy including iron and nickel (W—Fe—Ni alloy) is preferred as a material of the weight member 11.

The weight of the weight member 11 is not particularly limited. However, if the weight is too small, the moment of inertia of the club head 1 cannot be sufficiently increased, so the flight direction performance is deteriorated, and if the weight of the member 11 is too large, the applicable weight of the body 10 is limited, so there is a possibility that the size of the club head 1 is obliged to be made small.

Therefore, the weight of the weight member 11 is preferably at least 40 g, more preferably at least 50 g, further preferably at least 55 g, and it is preferably at most 120 g, more preferably at most 110 g, further preferably at most 100 g.

The weight member 11 has an internal circumference surface 11*i* which is fitted to the outside-facing surface 13*a* of the recess 14, an outer circumference surface 11*o* which will provide a rear part S2 of the club head's outer circumference surface E with continuing to the front part S1 to form the club head's outer circumference surface E when fitting to the body 10, a front surface 11*f* which faces the rear surface 12*c* of the face portion 12, and a rear surface 11*b* which is exposed on the back face 6. The weight member 11 or a relationship between its internal circumference surface 11*i* and the outside-facing surface 13*a* of the protrusion 13 may be such that it can be fitted to the outside-facing surface 13*a* by applying a large external pressing force to cause elastic deformation or plastic deformation of either one or both of the weight member 11 and the protrusion 13, namely by so-called press-fitting, or such that it can be easily fitted by hand work without applying a large pressing force.

The weight member 11 comprises a top weight portion 11A which extends outside of the top side rib 13A, a toe weight portion 11B which extends outside of the toe side rib 13B, a sole weight portion 11C which extends outside of the sole side rib 13C, and a heel weight portion 11D which extends outside of the heel side rib 13D. The weight member 11 in this embodiment shown in FIGS. 1 to 7 has a thickness Tw (shown in FIG. 3) measured in the direction perpendicular to the face 2 such that it gradually increases downward in the sole weight portion 11C.

Figure 2:
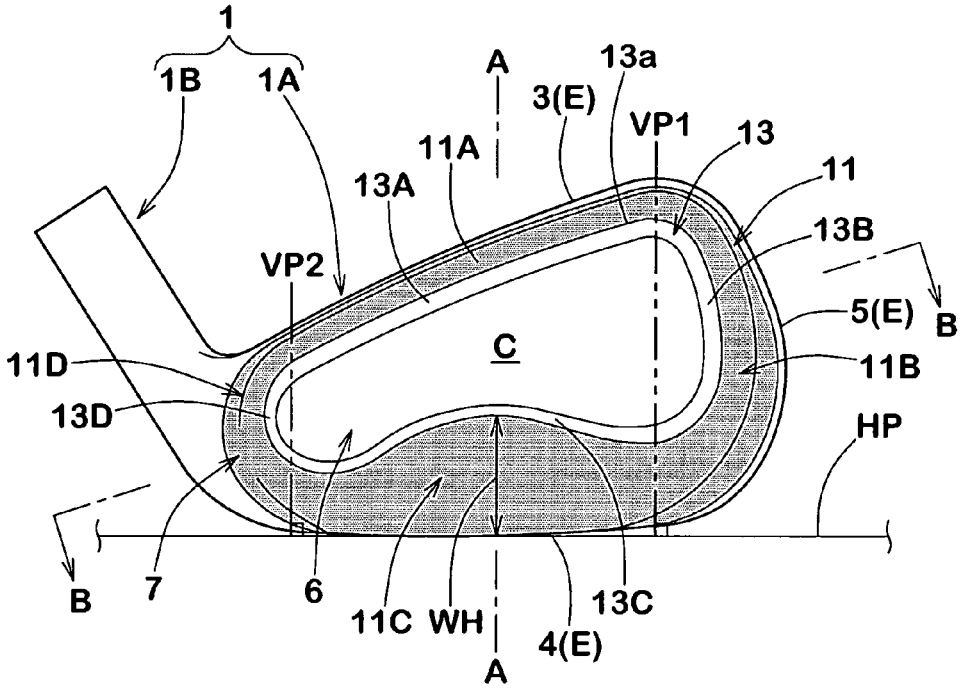
FIG. 2 is a back view of the club head of FIG. 1.

As shown in FIGS. 2 and 3, within a range viewable from the outside of the club head, the club head 1 shown in this embodiment has a weight member 11 such that the height WH of the sole weight portion 11C in the vertical direction between its inner and outer circumference surfaces 11*i* and 11*o* gradually increases from its central portion toward both toe and heel sides. Such a sole weight portion 11C is helpful to set the position in the toe-and-heel direction of the head's center of gravity to vicinity of the position of the maximum value of the height WH as well as lowering the center of gravity position. Therefore, the degree of freedom in designing the position of the club head's center of gravity is raised.

The weight member 11 is put into the recess 14 from the back side, thereby fitting its internal circumference surface 11*i* to the outside-facing surface 13*a* of the protrusion 13. Thereafter, the weight member 11 is strongly attached to the body 10 by a suitable fixing method, e.g., welding, adhesion, caulking and/or screwing, and others. Welding is preferable since a high adhesive strength is achieved. Welding is also helpful to improve the appearance since a molten metal flows into fine gaps between the body 10 and the weight member 11 to fill up the gaps. The welding can be performed by various methods. TIG welding, plasma welding and laser welding are preferable. TIG welding using a filler material is particularly preferable, since it can effectively fill up the gaps.

Preferably, the welding is applied to all boundary portions, which are viewable from the outside, between the body 10 and the weight member 11. After the welding, the side surface 12*b* of the face plate 12 which provides the front part S1 of the club head's outer circumference surface E, and the outer circumference surface 11*o* of the weight member 11, which provides the rear part S2, are easily finished into a single even surface as the club head's outer circumference surface E by polishing or the like.

According to the club head 1 as mentioned above, temporary assembling of the body 10 and the weight member can be easily performed with exact positioning by fitting the internal circumference surface 11*i* of the weight member 11 to the outside-facing surface 13*a* of the recess portion 14. Thus, mis-positioning and dislocation of the members 10 and 11 can be prevented when welding them, whereby generation of defective articles owing to welding failure can be decreased and the production yield is increased.

The thickness Tc of the weight member 11 at the fitting surface (hereinafter referred to as "fitting thickness Tc") where the internal circumference surface 11*i* of the weight member 11 is substantially fitted to the outer circumference surface 13*a* of the protruding portion 13, that is a thickness measured in the direction perpendicular to the face 2 and is identical, in this embodiment, to the outer circumference surface 13*a* or the height of the protruding portion 13, is preferably at least 2.0 mm, more preferably at least 2.5 mm, further preferably at least 3.0 mm, since the positioning and fitting are not conducted satisfactorily if the fitting thickness Tc is too small. On the other hand, if the fitting thickness Tc is too large, the fitting operation would become difficult and, therefore, it is preferably at most 15.0 mm, more preferably at most 13.0 mm, further preferably at most 11.0 mm. It is preferable that the fitting thickness Tc (the height of the protruding portion 13 from the peripheral edge portion 12P of the face plate 12) is the maximum at a center portion of the sole weight portion 11C and gradually decreases toward the both sides of the sole weight portion 11C.

The weight member 11 is disposed so that the outer circumference surface 11*o* thereof forms a rear part S2 of the club head's outer circumference surface E over substantially the entire region of the outer circumference surface E including the top 3, the sole 4 and the toe 5 with being exposed outwardly. Since much weight is allocated to a location farther spaced from the face center by such a configuration, the moment of inertia of the club head 1 is increased to remarkably improve the ball direction performance. The weight member 11 is not always required to form the entire region of the outer circumference surface E, but may form a part thereof. It is preferable that the outer circumference surface 11*o* of at least the top, sole and toe weight portions 11A, 11B and 11C are exposed to the outside so as to form the rear part S2 of the club head's outer circumference surface E.

The club head 1 in this embodiment as shown in FIGS. 1 to 7 has a moment of inertia of preferably at least 2,200 $g \cdot cm^2$, more preferably at least 2,250 $g \cdot cm^2$, further preferably at least 2,300 $g \cdot cm^2$. When a too large moment of inertia is desired, the side or weight of club head 1 will become excessively large. Therefore, it is preferable that the moment of inertia is at most 3,300 $g \cdot cm^2$, especially at most 3,250 $g \cdot cm^2$, more especially at most 3,200 $g \cdot cm^2$.

Figure 9:
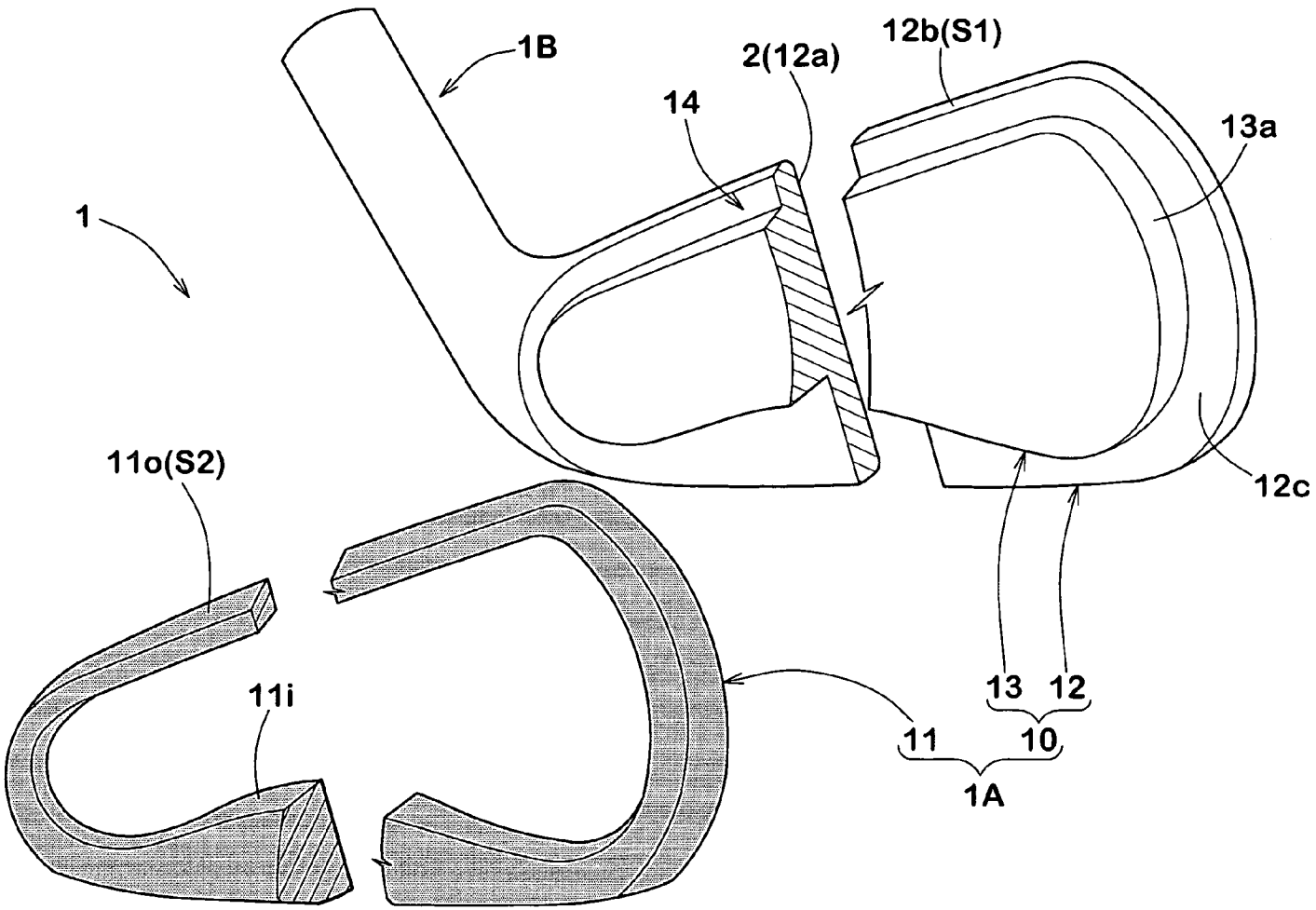
FIG. 9 is an exploded perspective view illustrating still another embodiment of the present invention.

While a preferable embodiment of the present invention has been described, it goes without saying that the present invention is not limited thereto and various changes and modifications may be made. For example, a cavity back iron-type golf club head has been described above, but the protruding portion 13 to be provided in the body 10 may be in the form of a block-like protrusion having no cavity C, as shown in FIG. 9, to give a muscle back iron-type golf club head.

The present invention is more specifically described and explained by means of the following Examples and Comparative Examples. It is to be understood that the present invention is not limited to these Examples.

EXAMPLES 1 AND 2 AND COMPARATIVE EXAMPLES 1 TO 4

Iron-type golf club heads (5-iron, loft angle 26°, head weight 255 g) were produced based on the specifications shown in Table 1, and the performances described below were measured for each of the club heads. In these Examples, a head body 10 was produced from a stainless steel (SUS 304, specific gravity 7.9) by precision casting, and a weight member 11 was produced from a W—Fe—Ni alloy (W:Fe:Ni=30:20:50 by weight, specific gravity 10.0) by precision casting. The body and the weight member were joined by TIG welding to give golf club heads excepting those of Example 2 and Comparative Example 3. The golf club heads produced in these examples have a structure as shown below.

Examples 1 and 2

Structure shown in FIGS. 1 to 7. In Example 2, the weight member was joined to the body by press-fitting.

Comparative Example 1

Figure 12A:
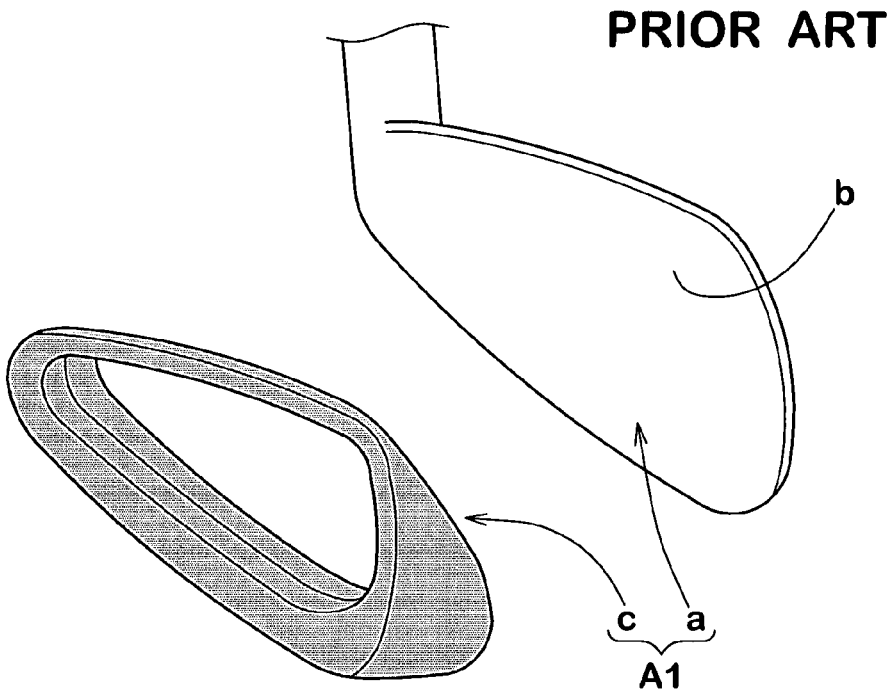
FIGS. 12(*a*) and 12(*b*) are an exploded perspective view and a cross sectional view of a conventional iron-type golf club head.
Figure 12B:
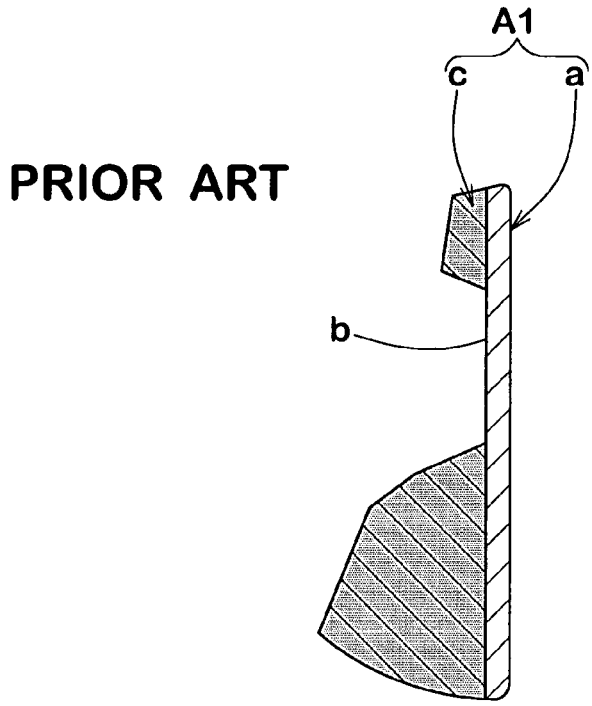

Structure shown in FIGS. 12(*a*) and 12(*b*) in which the back face of the body is flat.

Comparative Examples 2 AND 3

Figure 10A:
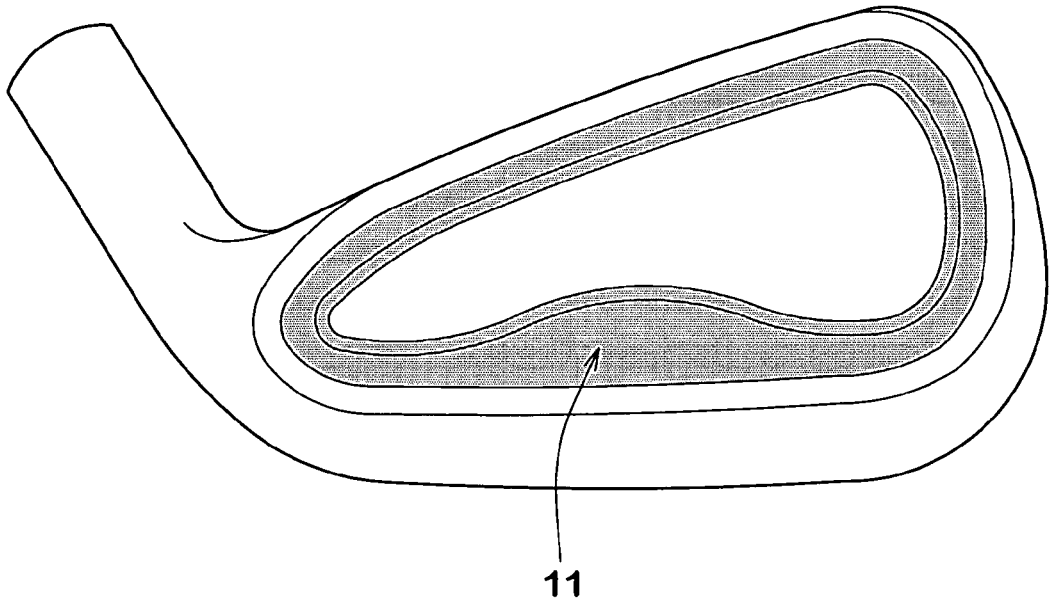
FIGS. 10(*a*) and 10(*b*) are a back view and a cross sectional view of an iron-type golf club head as prepared in Comparative Examples 2 and 3 described after.
Figure 10B:
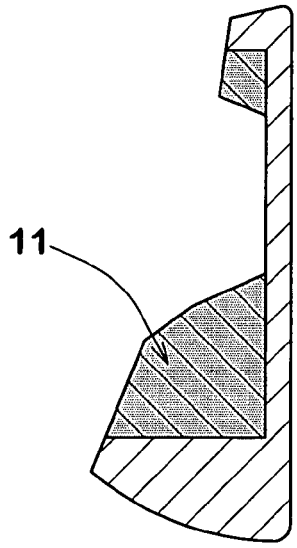

Structure shown in FIGS. 10(*a*) and 10(*b*) in which the outer circumference surface of weight member 11 is fitted into the internal circumference surface of a peripheral protruding portion of head body 10. In Comparative Example 3, the weight member was joined to the body by press-fitting.

Comparative Example 4

Figure 11A:
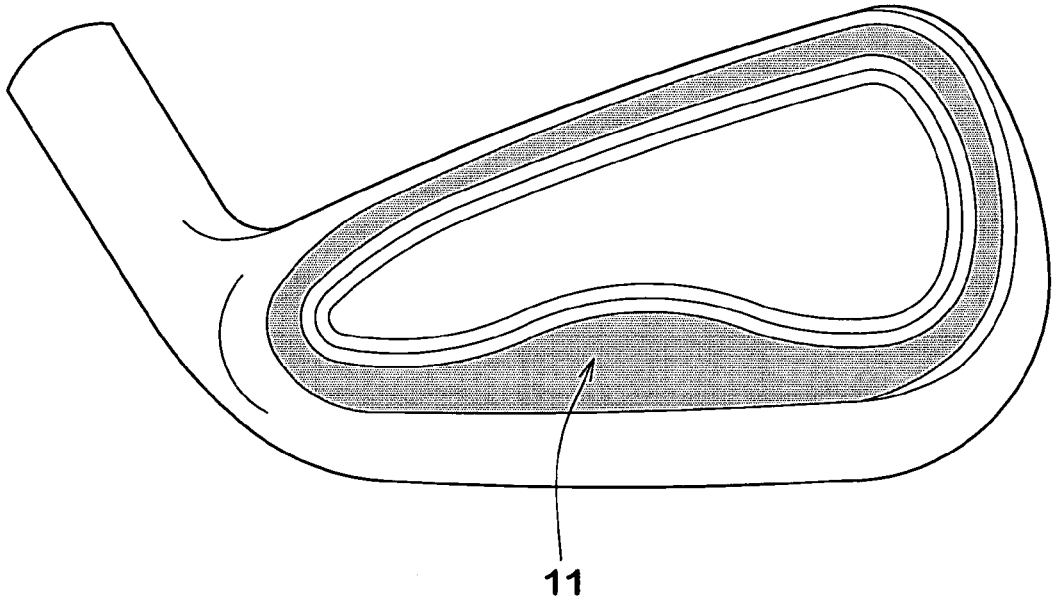
FIGS. 11(*a*) and 11(*b*) are a back view and a cross sectional view of an iron-type golf club head as prepared in Comparative Example 4 described after.
Figure 11B:
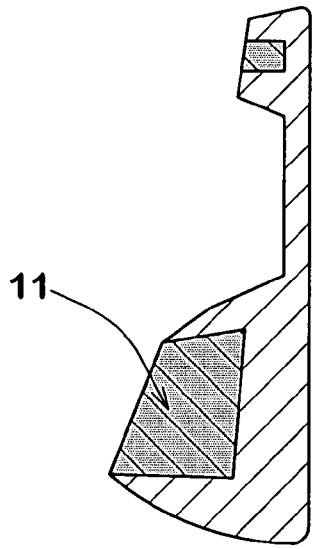

Structure shown in FIGS. 11(*a*) and 11(*b*) in which an annular groove having a pair of opposing groove walls is formed in body 10, and weight member 11 is fitted into the groove of the body and joined by welding.

(1) Moment of Inertia of Club Head

The moment of inertia about the vertical axis through the center of gravity of the golf club head was measured. The larger, the better.

(2) Direction Performance for Ball Struck

A shaft made of an FRP ("MP-400" shaft made by SRI Sports Limited) was attached to each of the club heads to give an iron-type golf club. Each of seven golfers hit 5 three piece golf balls (trade mark "XXIO", product of SRI Sports Limited) with each golf club to measure the stopping position of a ball and the amount of rightward or leftward swerve from the intended target course to the stop position of the ball (wherein the amount of swerve is treated as a positive value regardless of whether the swerve is rightward or leftward). The average value of the amount of swerve is obtained and is shown in Table 1 as an index based on the result of Example 1 regarded as 100. The smaller the value, the better the direction performance.

(3) Durability

Each of the above-mentioned iron-type golf clubs was attached to a swing robot (made by Miyamae Kabushiki Kaisha) and hit 5,000 golf balls per club at a head speed of 40 m/s. The presence of damage of the club head was visually observed every 100 shots, and the number of shots up to generation of damage was measured.

(4) Productivity

Thirty club heads were produced and visually observed, and the number of defective articles having dislocation between the body and the weight member and a gap at joining portion or deformation of joining portion was counted. The smaller the value, the better the productivity.

The results are shown in Table 1.

From these results, it is observed that the club heads of the Examples according to the present invention have a large moment of inertia and exhibit a good direction performance of hitting as compared with the Comparative Examples and, such club heads can be produced without lowering the productivity.

TABLE 1

| | Ex. 1 | Ex. 2 | Com. Ex. 1 | Com. Ex. 2 | Com. Ex. 3 | Com. Ex. 4 |
|---|---|---|---|---|---|---|
| Structure of club head | FIGS. 1-7 | FIGS. 1-7 | FIG. 12 | FIG. 10 | FIG. 10 | FIG. 11 |
| Method of joining body and weight member | welding | press-fitting | welding | welding | press-fitting | welding |
| Weight of body (g) | 180 | 180 | 165 | 180 | 180 | 180 |
| Weight of weight member (g) | 75 | 75 | 90 | 75 | 75 | 75 |
| Whole weight of club head (g) | 255 | 255 | 255 | 255 | 255 | 255 |
| Fitting thickness Tc (mm) | 3.0-12.5 | 3.0-12.5 | 0 | 3.0-12.5 | 3.0-12.5 | 3.0-10.0 |
| Results | | | | | | |
| Moment of inertia ($g \cdot cm^2$) | 2,600 | 2,600 | 2,680 | 2,300 | 2,300 | 2,400 |
| Direction performance (index) | 100 | 100 | 100 | 130 | 130 | 120 |
| Productivity (number of defectives) | 0 | 1 | 6 | 0 | 2 | 0 |
| Durability | No damage | Damaged at 2,800 shots | Damaged at 3,900 shots | No damage | Damaged at 2,600 shots | No damage |

What is claimed is:

1. An iron-type golf club head comprising a face portion including a front face for hitting a golf ball, a top extending from the upper edge of said front face and forming an upper surface of the club head, a sole extending from the lower edge of said front face and forming a bottom surface of the club head, a toe connecting said top and said sole on a toe side of the club head, and a back face, in which said face portion comprises a body having said front face on its front side, and an annular weight member which annularly extends along a peripheral edge portion on the back face side of said body and is fixed to the back face of said body and which has a larger specific gravity than that of said body, at least a part of said weight member is exposed onto the outer circumference surface of said face portion, said body is provided on its back face side with an annular recess portion which has an outside-facing surface capable of fitting to an internal circumference surface of said annular weight member and into which said weight member is fitted, and said body comprises a face plate and an annular protruding portion disposed on the rear surface of said face plate, in which said face plate includes a central portion surrounded by said annular protruding portion and a peripheral edge portion located outside of said annular protruding portion, the rear surface of said face plate is parallel to said front face at said central portion, and said protruding portion provides said outside-facing surface.

2. The golf club head of claim 1, wherein said body includes a face plate which provides a front part of the outer circumference surface of said face portion, and an annular protruding portion which protrudes on the back face side from the rear surface of said face plate at a location on the face center side with respect to the outer circumference surface of said face portion, and which is surrounded by said outside-facing surface, and said annular recess portion for fixing said weight member therein is constituted by the rear surface of said face plate, an outer circumference wall of said annular protruding portion which provides said outside-facing surface of said recess portion, and a corner portion formed by intersection of them, so that the club head periphery side of said annular recess portion is opened.

3. The golf club head of claim 2, wherein said annular weight member has an outer circumference surface which provides a rear part of the outer circumference surface of said face portion when fitted into said annular recess portion.

4. The golf club head of claim 2, wherein said face portion is provided on its back face with a cavity defined by said annular protruding portion in the form of an annular rib and dented toward its front face side.

5. The golf club head of claim 1, wherein said weight member has a sole weight portion extending along the sole in the toe-and-heel direction, and the height of said sole weight portion gradually decreases from its center portion toward both the toe and heel sides.

6. An iron-type golf club head comprising a face portion including a front face for hitting a golf ball, a top extending from the upper edge of said front face and forming an upper surface of the club head, a sole extending from the lower edge of said front face and forming a bottom surface of the club head, a toe connecting said top and said sole on a toe side of the club head, and a back face, in which said face portion comprises a body having said front face on its front side, and an annular weight member which annularly extends along a peripheral edge portion on the back face side of said body and is fixed to the back face of said body and which has a larger specific gravity than that of said body, at least a part of said weight member is exposed onto the outer circumference surface of said face portion, said body is provided on its back face side with an annular recess portion which has an outside-facing surface capable of fitting to an internal circumference surface of said annular weight member and into which said weight member is fitted, and said body comprises a face plate and an annular protruding portion disposed on the rear surface of said face plate, in which said face plate includes a central portion surrounded by said annular protruding portion and a peripheral edge portion located outside of said annular protruding portion, the thickness t1 of said central portion of the face plate is from 1.5 to 3.8 mm and is smaller than the thickness of said peripheral edge portion, and said protruding portion provides said outside-facing surface.

7. The golf club head of claim 6, wherein said face portion is provided on its back face with a cavity defined by said annular protruding portion which is in the form of an annular rib, and dented toward its front face side.

8. The golf club head of claim 6, wherein said weight member has a sole weight portion extending along the sole in the toe-and-heel direction, and the height of said sole weight portion gradually decreases from its center portion toward both the toe and heel sides.

9. An iron-type golf club head comprising a face portion including a front face for hitting a golf ball, a top extending from the upper edge of said front face and forming an upper surface of the club head, a sole extending from the lower edge of said front face and forming a bottom surface of the club head, a toe connecting said top and said sole on a toe side of the club head, and a back face, in which said face portion comprises a body having said front face on its front side, and an annular weight member which annularly extends along a peripheral edge portion on the back face side of said body and is fixed to the back face of said body and which has a larger specific gravity than that of said body, at least a part of said weight member is exposed onto the outer circumference surface of said face portion, said body is provided on its back face side with an annular recess portion which has an outside-facing surface capable of fitting to an internal circumference surface of said annular weight member and into which said weight member is fitted, said body comprises a face plate and an annular protruding portion disposed on the rear surface of said face plate, in which the rear surface of said face plate is parallel to said front face, and said annular weight member has a sole weight portion extending along the sole in the toe-and-heel direction, and said sole weight portion has the maximum thickness measured in the direction perpendicular to said front face at a location below its internal circumference surface.

10. The golf club head of claim 9, wherein said face portion is provided on its back face with a cavity defined by said annular protruding portion which is in the form of an annular rib, and dented toward its front face side.

11. The golf club head of claim 9, wherein the height of said sole weight portion gradually decreases from its center portion toward both the toe and heel sides.

* * * * *